US010913590B2

(12) United States Patent
Steele

(10) Patent No.: US 10,913,590 B2
(45) Date of Patent: Feb. 9, 2021

(54) MIXING PACKAGE AND METHOD

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 209 days.

(21) Appl. No.: 15/814,843

(22) Filed: Nov. 16, 2017

(65) Prior Publication Data

US 2018/0170652 A1 Jun. 21, 2018

Related U.S. Application Data

(60) Provisional application No. 62/422,673, filed on Nov. 16, 2016.

(51) Int. Cl.

| | |
|---|---|
| ***B65D 81/32*** | (2006.01) |
| ***B65D 51/28*** | (2006.01) |
| ***B65D 25/08*** | (2006.01) |
| ***B65D 51/16*** | (2006.01) |
| ***B65D 33/25*** | (2006.01) |
| *B01F 3/12* | (2006.01) |

(52) U.S. Cl.

CPC ..... *B65D 81/32* (2013.01); *B65D 25/08* (2013.01); *B65D 33/2508* (2013.01); *B65D 51/1616* (2013.01); *B65D 51/28* (2013.01); *B01F 3/1228* (2013.01); *B65D 2575/583* (2013.01)

(58) Field of Classification Search

CPC .. B65D 81/32; B65D 81/51828; B65D 25/08; B65D 2575/583; B65D 81/28; B01F 5/06

USPC ..... 206/219

See application file for complete search history.

(56) References Cited

U.S. PATENT DOCUMENTS

| | | | | |
|---|---|---|---|---|
| 4,402,402 | A | 9/1983 | Pike | |
| 4,519,499 | A | 5/1985 | Stone et al. | |
| 4,557,377 | A | 12/1985 | Maloney | |
| 4,588,554 | A | 5/1986 | Kaartinen et al. | |
| 4,806,021 | A | 2/1989 | Koudstaal et al. | |
| 4,877,334 | A | 10/1989 | Cope | |
| 5,154,321 | A * | 10/1992 | Shomer | B01F 5/0683 206/219 |
| 5,209,347 | A | 5/1993 | Fabisiewicz et al. | |
| 5,353,927 | A | 10/1994 | Stupar et al. | |
| 5,373,966 | A | 12/1994 | Oreilly et al. | |
| 5,380,093 | A | 1/1995 | Goldman | |
| 5,492,219 | A | 2/1996 | Stupar | |
| 5,660,868 | A | 8/1997 | Yeager | |
| 5,826,401 | A * | 10/1998 | Bois | B65B 9/20 53/412 |
| 6,023,914 | A | 2/2000 | Richison et al. | |
| 6,036,004 | A | 3/2000 | Bowen | |
| 6,234,675 | B1 | 5/2001 | Sand et al. | |
| 6,245,367 | B1 | 6/2001 | Galomb | |
| 6,298,983 | B1 | 10/2001 | Yeager | |

(Continued)

*Primary Examiner* — Steven A. Reynolds
*Assistant Examiner* — Javier A Pagan
(74) *Attorney, Agent, or Firm* — Skaar Ulbrich Macari, P.A.

(57) ABSTRACT

A pouch or package (e.g., flexible package) having a containment compartment or chamber to securely seal and to segregate fine powders or other such products from another area of the package. A powder resistant sealable filter material is included between, or extending between edges of, opposing package panels. Water, or other liquids, can be added to the product through the material as this material allows liquid to pass through it to mix with the powder, but restricts passage of the powder back through.

18 Claims, 4 Drawing Sheets

(56) References Cited

U.S. PATENT DOCUMENTS

| | | | |
|---|---|---|---|
| 6,375,037 | B1 | 4/2002 | Bell et al. |
| 7,883,268 | B2 | 2/2011 | Steele |
| 9,963,284 | B2 | 5/2018 | Steele |
| 10,011,399 | B1 * | 7/2018 | Adell ..... B29C 65/76 |
| 10,155,354 | B2 | 12/2018 | Steele |
| 10,427,851 | B2 | 10/2019 | Steele et al. |
| 2001/0030134 | A1 | 10/2001 | Goglio et al. |
| 2002/0067865 | A1 | 6/2002 | Stutzman |
| 2004/0031244 | A1 | 2/2004 | Steele |
| 2009/0080810 | A9 | 3/2009 | Steele |
| 2009/0175563 | A1 | 7/2009 | Weaver |
| 2009/0208147 | A1 | 8/2009 | Steele |
| 2009/0238499 | A1 | 9/2009 | Steele |
| 2011/0103714 | A1 | 5/2011 | Steele et al. |
| 2012/0074002 | A1 | 3/2012 | Steele et al. |
| 2012/0138848 | A1 | 6/2012 | Leavitt et al. |
| 2015/0253057 | A1 | 9/2015 | Leavitt et al. |
| 2017/0355502 | A1 | 12/2017 | Steele |
| 2020/0255202 | A1 | 8/2020 | Steele |

* cited by examiner

MIXING PACKAGE AND METHOD

PRIORITY

The Application claims priority to and the benefit of U.S. Provisional Patent Application No. 62/422,673, filed Nov. 16, 2016, which is incorporated fully herein by reference.

FIELD

The present invention relates generally to packaging and, more particularly, to packages, and methods for manufacturing and using packages, having a containment compartment to facilitate mixing of a fine powder or other product with one or more fluids.

BACKGROUND

In many conventional package applications, powders or products of the like can be either caustic, or at least an irritant, if a user were to ingest or breathe them in—either directly or via transfer from the user's hands or other means. To make it even more of an issue, some products need to be mixed with fluid, such as water, before use. The simple opening of the package containing the powder can cause the fine particles to become airborne, or the particles can become airborne while the fluid is being added.

In addition, the chemical reaction of mixing fluids with powders can cause a gassing-off of the product. A means to allow the gas to escape must also be addressed.

As a result, there is a need for a package that substantially solves the above-referenced problems with conventional package designs, configurations, and manufacturing methods, including a package to facilitate safe and secure mixing, and degassing within the package, if necessary.

SUMMARY

Embodiments of the present invention include a pouch or package (e.g., flexible package) having a containment compartment or chamber to securely seal and to temporarily segregate fine powders or other such products from another area of the package. A powder resistant sealable filter material is included between, or extending between edges of, opposing package panels. Water, or other liquids or fluids, can be added to the product through the material as this material allows fluid to pass through it to mix with the powder, but does not allow the powder to pass back through it and get outside the package or on the consumer.

When in use, the consumer will remove the top seal above a closure device, if a top seal is present, open the device, and pour the water or other liquid onto the powder resistant sealable filter material. Ice can also be used or introduced, which will slowly drip water through the material as it melts. The water will filter through the material and mix with the powder. As gasses or trapped air builds up in the lower portion of the package, it could become trapped if the entire powder resistant material was able to become wet. However, the partial vertical seals keep the ends of the powder resistant sealable filter material dry which, in turn, allows any gas building up within the lower compartment to penetrate the powder resistant sealable filter material and escape past the top of the vertical seals (e.g., via gaps) and out the closure proximate to where the water is being added. Once the proper amount of liquid is added, the closure device can be closed and the mixed product (e.g., now mixed with liquid) will be contained within the entire package. The product can be further mixed by shaking the package, or if desired, dispensed out through the closure device—or any other form of dispensing. With some products, the liquid remains contained within the package while being used and the closure device is only used for dispensing of the product after use.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 2:
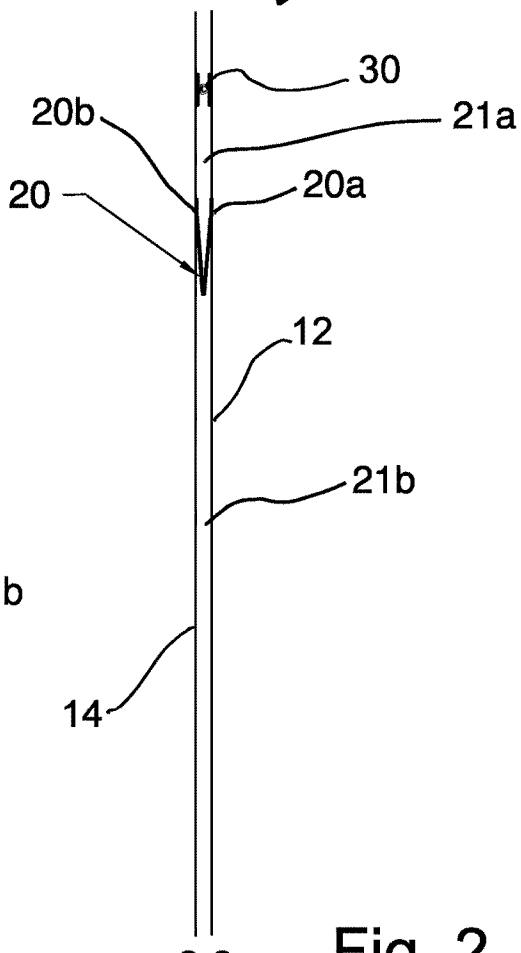
FIG. 2 shows a sectional view along 2-2 of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed or crushed portions and/or integrated devices for the package.

DETAILED DESCRIPTION OF THE INVENTION

Referring generally to FIGS. 1-6, a package 10 (e.g., flexible) in accordance with the present invention is shown. The package 10 can include a containment compartment or chamber to securely seal and to temporarily segregate fine powders or other such products 11 from another area of the package 10. Introduced water or other fluids/liquids can seep through a powder resistant material to mix with the product 11.

In certain embodiments, the product 11 can include a coolant powder, such as that sold and marketed as "Frosty Tech™" by Frosty Cold of Kansas, United States. When mixed with water, such a coolant powder gets colder than ice in a matter of seconds—even at high ambient temperatures. The water can evaporate off, leaving the powder for multiple uses with the package 10 of the present invention (after adding water again). Other powders or like product materials (e.g., granular or particle products) can also be included with the present invention.

The package 10 generally includes a front panel portion 12, and a back panel portion 14. Further, a bottom panel portion 15, gusseted or non-gusseted, can be included, especially in those embodiments defining a stand-up package. The joining and/or shaping of the panels 12, 14, 15, generally define an inner cavity having an adjustable internal volumetric capacity. The inner cavity is capable of storing, transporting, and/or dispensing product or other objects and material therein. Side panel portions, gusseted or non-gusseted, may also be included. The panel portions 12, 14, 15 are often referred to as webs, films, or layers.

References to "top," "bottom," "front," "side," "back" and the like are for illustrative purposes only and are not meant to limit the scope of the disclosed invention.

The package according to the invention can include packages constructed, in whole or in part, of flexible, rigid, semi-rigid, or semi-flexible materials or panels. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention, in certain embodiments, permits the flexible package to be made using less expensive or cheaper materials than would otherwise be necessary.

In various embodiments, the front panel portion 12 and the back panel portion 14 will be formed of one contiguous web material. In alternative embodiments, at least one of the panel portions can be distinct web materials joined or sealed to other respective panel portions to form the package 10 of the present invention. For instance, the front panel portion 12 and the back panel portion 14 can be joined to each other from distinct non-contiguous web sheets of material, and one of the panel portions 12-14 can further extend to define the bottom panel portion 15. The bottom panel portion 15 in the various configurations forming a stand-up pouch can include a gusset known to those skilled in the art to further promote operative expansion and contraction of the package 10 and its respective capacity in accordance with the receipt and removal of material within the package 10.

Figure 1:
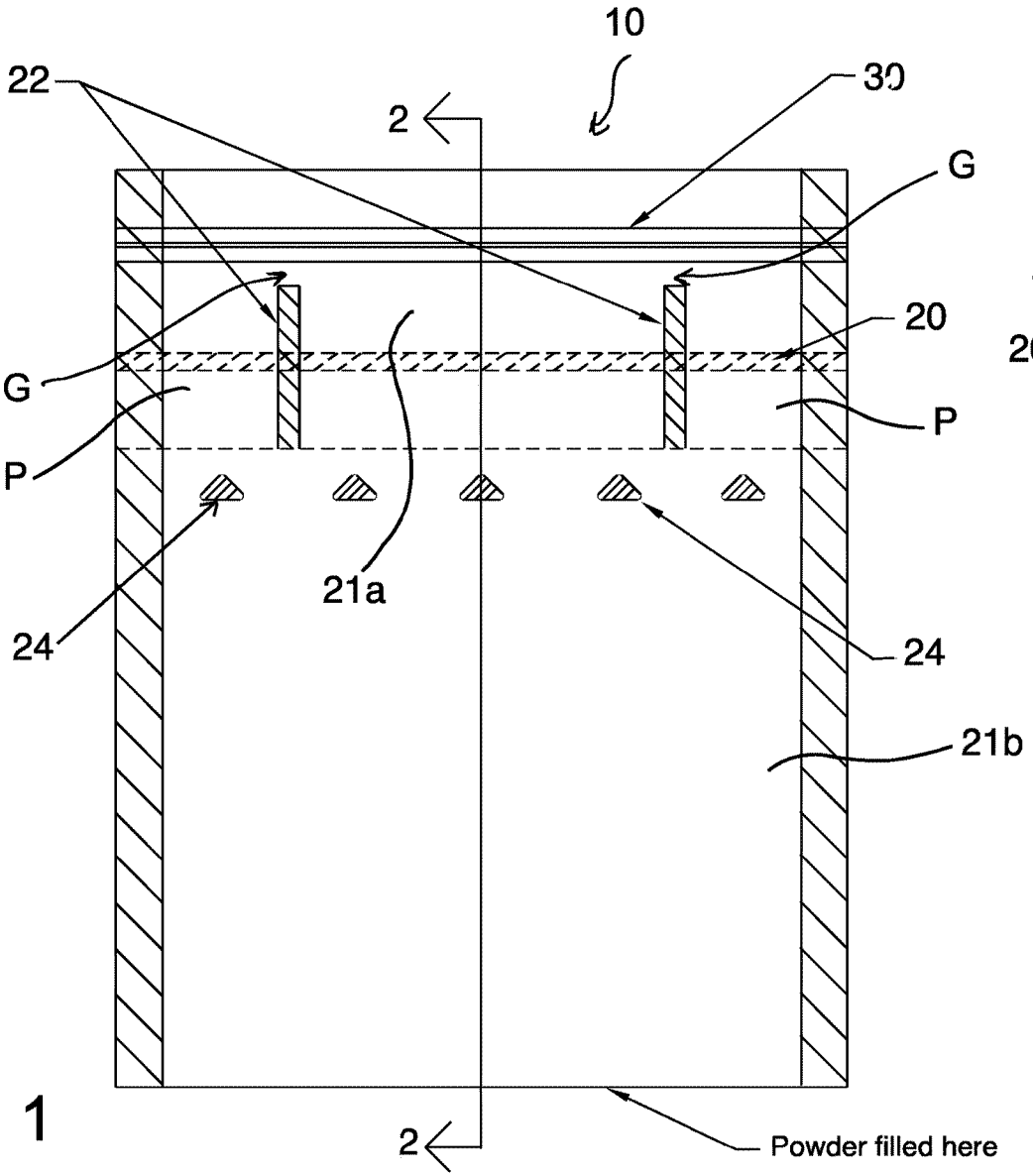
FIG. 1 shows a package having a powder resistant sealable filter material between opposing panels, in accordance with embodiments of the present invention.

Referring to FIGS. 1-2, embodiments of the present invention include a pouch or package (e.g., flexible package) 10 having a powder resistant sealable filter material or strip 20 (e.g., woven or non-woven) sealed between the front and back panels 12, 14. The material 20 can be folded down its length, with one edge or end 20*a* sealed to the front panel 12, and the other edge or end 20*b* sealed to the back panel 14 to create a gusset between the panels 12, 14. Distal end portions of the material 20 can be sealed into longitudinal side edges or seals of the package such that the material 20 ends are sealed to and between both panels 12, 14. This material 20 can be added to the upper region of the package in certain embodiments, but can be positioned anywhere along the length of the panels 12, 14. Further, the material 20 can include one or more layers, depending on the porosity or density of the material being used to block the different granular powder sizes, while still allowing the liquid to pass through. The material 20 can be heat sealed to the package, provided with an adhesive, or applied using like attachment methods, structures, and techniques. The material 20 contributes in defining the product compartment 21*b* and segregates it from a liquid introduction compartment 21*a*.

Various embodiments of the material 20 can be a powder resistant sealable filter material that can function similar to a coffee filter—letting water penetrate through it while not letting the product (e.g., like coffee ground) through. The material 20 can include a thin polymer (e.g., Polyethylene) layer. The material 20 can then be embossed (or impregnated or mixed) to push the polymer through to the other side, as the material fibers break at the points of an embossing wheel. The tiny holes or apertures created allow the water to drip through, but are too small to allow the fine powder granules or particles to pass. When embossed, the polymer can be on both sides of a non-woven material so it can be sealed to a package portion as detailed herein. In other embodiments, the material 20 can be formed or made liquid permeable, or porous, with various manufacturing or formation techniques—e.g., tiny etching, stitching, puncturing, perforating, scoring, and the like.

A closure or re-closeable device 30, such as a zipper or other closure mechanism, can be added above the material 20, adjacent the material 20, and the like. In various embodiments, the closure device 30 will be leak proof or leak resistant.

One or more vertical or shaped seals 22 can be included extending from or proximate the bottom fold, or a portion below, of the material 20 up to a section below, or immediately below, the closure device 30. As such, a gap G will remain between the top or end edges of the one or more seals 22 and the bottom of the closure device 30. These gaps G will allow gas (e.g., air) to later escape by passing therethrough. The liquid introduction region 21*a* can be defined between the seals 22 to facilitate introduction and passage of the liquid through the material 20 and into the compartment 21*b*.

One or more segment seals 24 can be included below or proximate the material 20 to keep the weight or mass of the powder in the package from pressing against the material 20—thereby minimizing or eliminating the migration of any powder through the material 20. The seals 24 can take on various shapes, sizes, and constructs, and can seal limited sections of the package panels (e.g., 12 and 14) together to create a plurality of gaps or passages therebetween.

This package including the material 20 allows for a fine powder product 11, or other like product that requires containment from contact, to be sealed securely within a compartment. Water, or other liquids, can be added to the product 11 through the material 20 as this material 20 allows liquid to pass through it to mix with the powder, but does not allow, or minimizes the amount of, the powder to pass back through it and get outside the package 10 or on the consumer.

Figure 3:
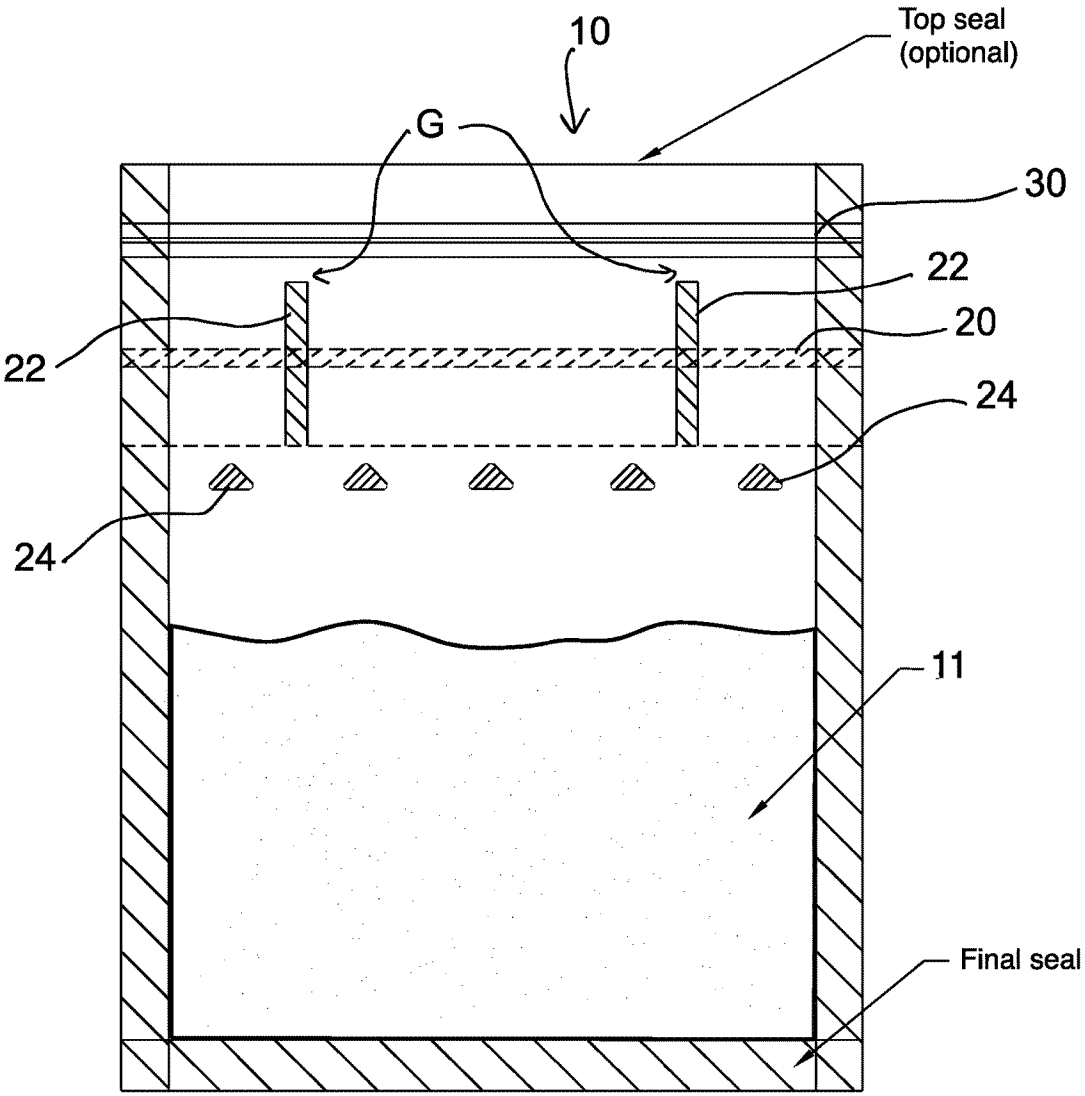
FIG. 3 shows a package including product below a powder resistant sealable filter material between opposing panels, in accordance with embodiments of the present invention.
Figure 4:
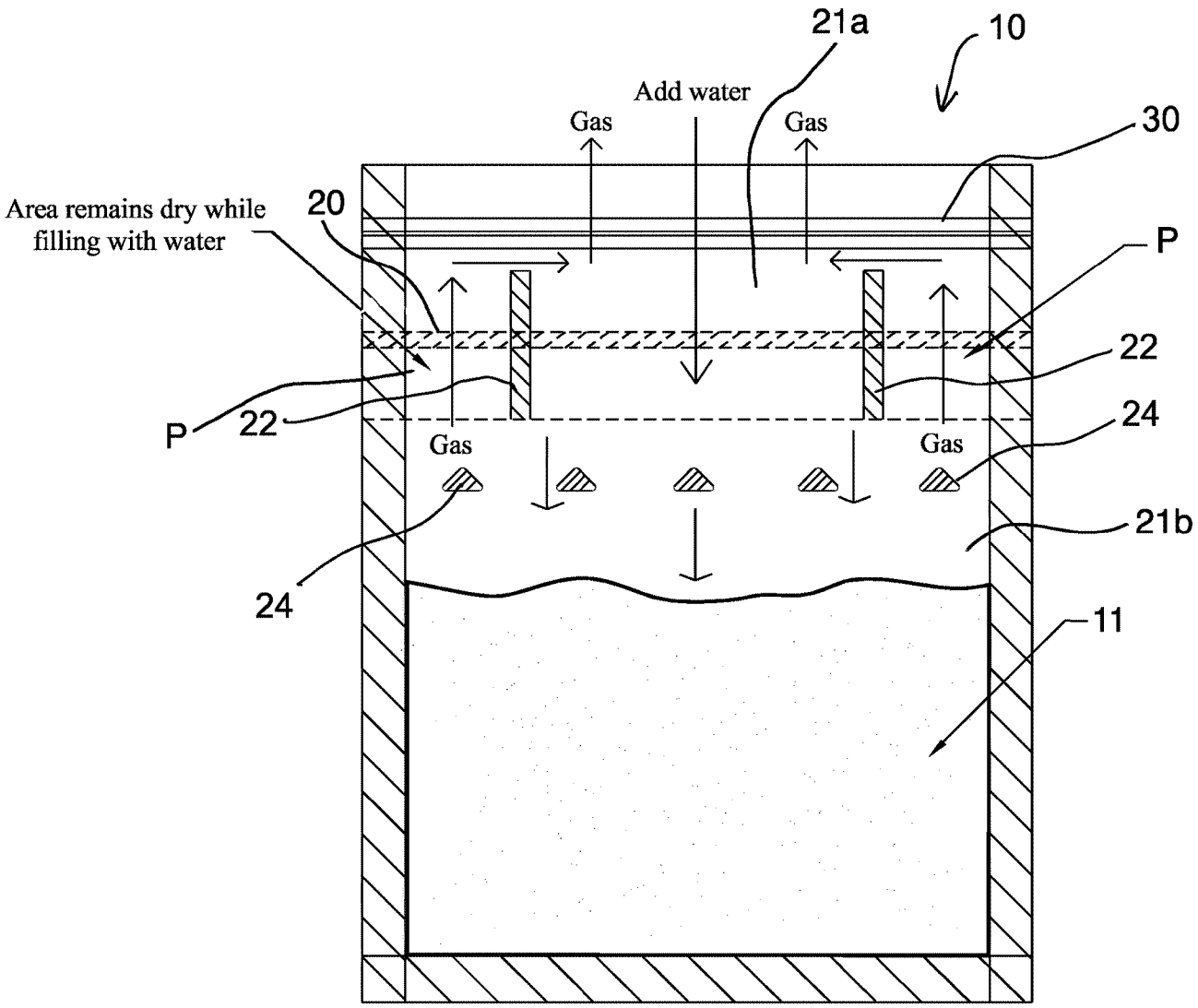
FIG. 4 shows a package with water or other liquid being introduced to seep through the powder resistant sealable material for mixing with the product, in accordance with embodiments of the present invention.

It may be possible for the small pours in the material 20 to close up or clog up when wet in certain embodiments, and this may not allow the gas (e.g., air) trapped in the compartment with the powder to escape back through. For instance, a type of vapor lock can be created and as the pressure builds within the compartment where the powder and liquid are mixing, and the pressure itself, or vapor lock, can slow down the process of allowing the water to pass through the material 20. As such, to remedy this potential issue, a section of the material can be kept dry, with a proximate passage P to allow for the gasses to pass through it and out of the package, as shown in FIGS. 3-4. Other means of venting could also be implemented without deviating from the spirit and scope of the present invention.

The supplier can fill the package 10 with the powder product 11 through the opposite end of the package (e.g., bottom) from where the closure device 30 is located and seal that end of the package closed upon completion of the filling process. The powder 11 is then confined within the lower portion of the package, in compartment 21*b*, below the powder resistant sealable filter material 20. A seal can be made above the closure device 30. However, such a seal may not be necessary as the product 11 is contained within or below the powder resistant sealable filter material 20. A seal (e.g., top package seal) can be added if the powder 11 is susceptible to moisture or contaminates, for instance.

As shown in FIGS. 3-4, when in use, the consumer can remove the top seal above the closure device 30, if a top seal is present, open the device 30, and pour the water or other liquid at the compartment 21*a* and onto the powder resistant sealable filter material 20. Ice can also be used or introduced, which will slowly drip water through the material 20 as it melts. The water will filter through the material 20 and mix with the powder 11. As gasses or trapped air builds up in the lower portion of the package (e.g., compartment 21*b*), it could become trapped if the entire powder resistant sealable filter material 20 was able to become wet. However, the partial vertical seals 22 keep the ends of powder resistant sealable filter material 20 dry at the passageway P which, in turn, allows any gas building up within the lower compartment to penetrate the powder resistant sealable filter material 20 and escape past the top of the vertical seals 22 (e.g., via the gaps G) and out the closure 30 next to where the water is being added. The water seeps through the material 20, between the vertical seals 22. Once the proper or desired amount of water is added, the closure device 30 can be closed and the mixed product 11 (e.g., now mixed with fluid) will be contained within the package 10. The product 11 can be further mixed by shaking the package 10, or if desired, dispensed out through the closure device 30—or via any other form of dispensing. With some products, the liquid remains contained within the package 10 while being used and the closure device 30 is only used for dispensing of the product after use.

Figure 6:
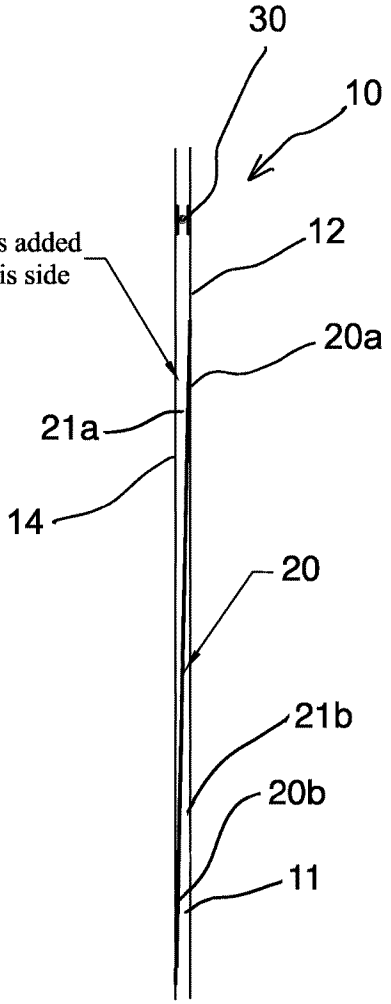
FIG. 6 shows a sectional view along 6-6 of FIG. 5.
Figure 5:
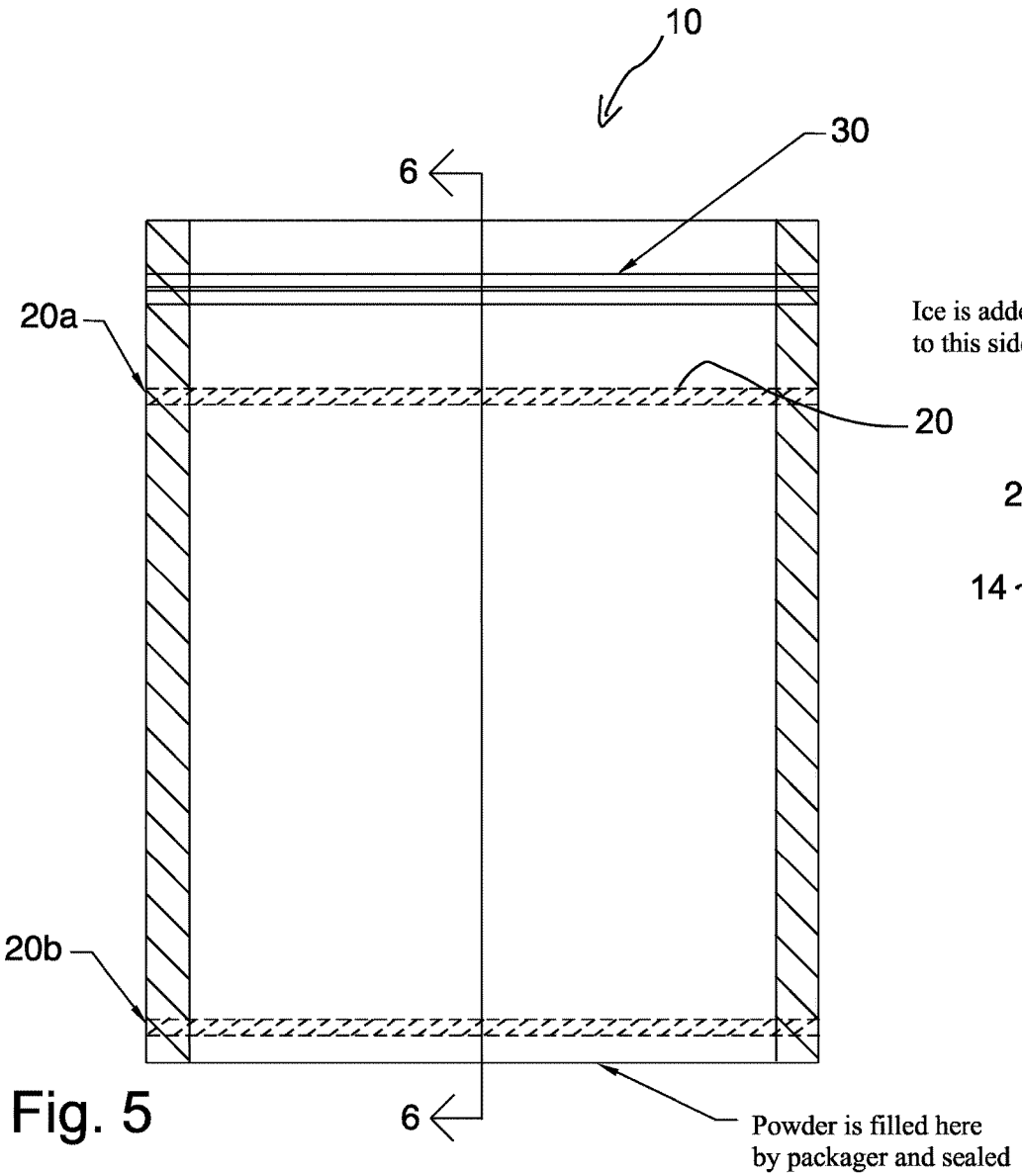
FIG. 5 shows a package having a longitudinally placed powder resistant sealable filter material between opposing panels, in accordance with embodiments of the present invention.

Referring to FIGS. 5-6, an embodiment of the present invention is provided with a length of the material 20 sealed at one edge region 20*a* to the first panel 12, and at the opposing end region 20*b* to a distal or opposed region of the back panel 14. Such embodiments can be included for application of water or ice on one side of the material 20, and product 11 included on the opposing side of the material 20. As detailed herein, the water, or melted ice, will seep through the material 20 and mix with the product 11 contents.

The package 10 according to the invention can include packages constructed, in whole or in part, of flexible, rigid, semi-rigid, or semi-flexible materials or panels.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive packages. Further, features and aspects of the various embodiments described herein can be combined to form additional embodiments within the scope of the invention even if such combination is not specifically described herein.

References to front, back and side panels for the package and package formation embodiments described herein are provided to facilitate an understanding of orientation and direction and are not intended to be limiting. For instance, the material 20, closure devices, seals, and other structures or portions of the package, can be provided to or along any portion of the package regardless of the references herein to front, back, side, bottom and the like.

What is claimed is:

1. A mixing package, comprising:

a first panel portion and a second panel portion;

a filter web material having a first edge portion and a second edge portion, the first edge portion being attached to a first interior surface of the first panel portion and the second edge portion being attached to a second interior surface of the second panel portion such that a separate interior powder product compartment is defined to contain a powder product, the filter web material constructed of a porous and liquid permeable material such that a liquid is introducible into the interior powder product compartment through the filter web material and the powder product is restricted from passing through the filter web material; and opposing vertical seals provided transverse to the filter web material to create a passageway at least substantially free of liquid.

2. The package of claim 1, wherein the opposing vertical seals are generally aligned with a longitudinal length of the package.

3. The package of claim 1, further including a plurality of segment seals provided proximate the filter web material.

4. The package of claim 1, further including a re-closeable device provided proximate the filter web material.

5. The package of claim 4, wherein the re-closeable device includes a zipper device.

6. The package of claim 1, further including a first package end portion adapted for filling the interior powder product compartment with the powder product.

7. The package of claim 6, further including a second package end portion, opposite the first package end portion, having an end seal.

8. The package of claim 1, wherein the first edge portion and the second edge portion are generally opposingly aligned within the package.

9. The package of claim 1, wherein the first edge portion is attached to a top portion of the first panel portion and the second edge portion is attached to a bottom portion of the second panel portion opposite the top portion.

10. The package of claim 9, wherein ice is introducible to a side of the filter web material such that the ice melts and seeps through the filter web material to contact the powder product.

11. The package of claim 1, wherein a gap is provided between the opposing vertical seals and a top portion of the package to facilitate outgas sing.

12. A mixing package, comprising:

a first panel portion and a second panel portion;

a filter web material having a first edge portion and a second edge portion, the first edge portion being attached to a first interior surface of the first panel portion and the second edge portion being attached to a second interior surface of the second panel portion such that a separate interior powder product compartment is defined to contain a powder product, the filter web material constructed of a porous and liquid permeable material such that a fluid is introducible into the interior powder product compartment through the filter web material and the powder product is restricted from passing through the filter web material; and opposing vertical seals provided transverse to the filter web material, with a gap provided proximate at least one of the opposing vertical seals to facilitate outgassing.

13. The package of claim 12, wherein the opposing vertical seals are generally aligned along a longitudinal length of the package.

14. The package of claim 12, further including a plurality of segment seals provided proximate the filter web material.

15. The package of claim 12, further including a recloseable device provided proximate the filter web material.

16. The package of claim 12, wherein the first edge portion and the second edge portion are generally opposingly aligned within the package.

17. The package of claim 12, wherein the first edge portion is attached to a top portion of the first panel portion and the second edge portion is attached to a bottom portion of the second panel portion opposite the top portion.

18. The package of claim 17, wherein ice is introducible to a side of the filter web material such that the ice melts and seeps through the filter web material to contact the powder product.

* * * * *